US009526350B2

(12) United States Patent
Kuusela

(10) Patent No.: US 9,526,350 B2
(45) Date of Patent: Dec. 27, 2016

(54) ARRANGEMENT CONVERTIBLE INTO BABY CARE ITEMS

(71) Applicant: Mia Kuusela, Vasteras (SE)

(72) Inventor: Mia Kuusela, Vasteras (SE)

( * ) Notice: Subject to any disclaimer, the term of this patent is extended or adjusted under 35 U.S.C. 154(b) by 36 days.

(21) Appl. No.: 14/410,936

(22) PCT Filed: Jul. 1, 2013

(86) PCT No.: PCT/FI2013/050722
§ 371 (c)(1),
(2) Date: Dec. 23, 2014

(87) PCT Pub. No.: WO2014/001650
PCT Pub. Date: Jan. 3, 2014

(65) Prior Publication Data

US 2016/0183696 A1 Jun. 30, 2016

Related U.S. Application Data

(60) Provisional application No. 61/665,966, filed on Jun. 29, 2012.

(30) Foreign Application Priority Data

Jun. 29, 2012 (FI) ..... 20125752

(51) Int. Cl.
*A47C 15/00* (2006.01)
*A47D 11/00* (2006.01)
(Continued)

(52) U.S. Cl.
CPC ..... *A47D 11/00* (2013.01); *A45C 9/00* (2013.01); *A45C 13/30* (2013.01); *A47D 5/006* (2013.01);
(Continued)

(58) Field of Classification Search
CPC ..... A45C 9/00; A45C 13/30; A47D 11/00; A47D 11/02; A47D 13/02; A47D 15/006
(Continued)

(56) References Cited

U.S. PATENT DOCUMENTS 3,604,750 A 9/1971 Doering
4,235,474 A * 11/1980 Rosenberg ..... A47D 15/006 297/485 X
(Continued)

FOREIGN PATENT DOCUMENTS

EP 2077082 A1 7/2009
WO 85/01197 A1 3/1985
(Continued)

OTHER PUBLICATIONS

International Search Report, dated Nov. 12, 2013, from corresponding PCT application.
(Continued)

*Primary Examiner* — Rodney B White
(74) *Attorney, Agent, or Firm* — Young & Thompson

(57) ABSTRACT

An arrangement convertible into several baby care items. The prior art knows solutions to combine some baby care items, such as a chair padding and a bag, but these combinations are difficult to use and more items are required to carry with when traveling with a baby. The present arrangement can be converted into a folded form forming a bag, into a semi-folded form forming chair padding, and into an unfolded form forming, when the material is set the first side up, a changing mat for diaper changing, or, when the material is set the second side up, an infant carrier, which can be fastened to a chair or carried by a person.

17 Claims, 4 Drawing Sheets

Figure 1:
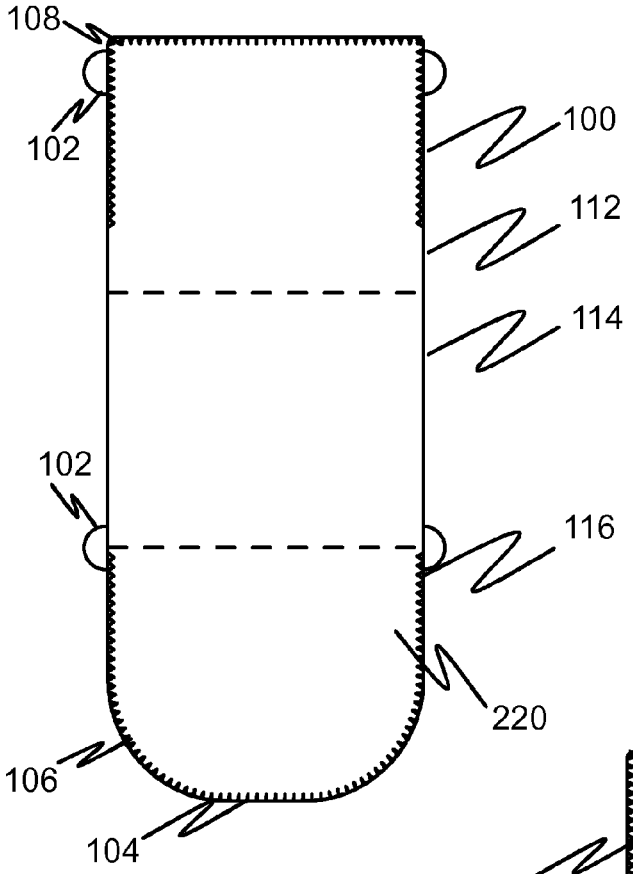

(51) Int. Cl.

| | |
|---|---|
| ***A45C 9/00*** | (2006.01) |
| ***A45C 13/30*** | (2006.01) |
| ***A47D 11/02*** | (2006.01) |
| ***A47D 15/00*** | (2006.01) |
| ***A47D 5/00*** | (2006.01) |
| ***A47D 13/02*** | (2006.01) |

(52) U.S. Cl.
CPC ..... *A47D 11/02* (2013.01); *A47D 13/02* (2013.01); *A47D 15/006* (2013.01); *A45C 2009/002* (2013.01); *A45C 2200/20* (2013.01)

(58) Field of Classification Search
USPC ..... 297/118, 129, 219.12, 485
See application file for complete search history.

(56) References Cited

U.S. PATENT DOCUMENTS 4,702,523 A * 10/1987 Schrader ..... A47D 15/006 297/485 X
4,712,258 A * 12/1987 Eves ..... A47D 5/006 5/420
4,863,003 A * 9/1989 Carter ..... A45C 9/00 297/118 X
4,942,948 A * 7/1990 Vickers ..... A45C 3/10 297/118 X
5,210,891 A * 5/1993 Avital ..... A45C 3/10 224/156
5,243,724 A 9/1993 Barnes
5,439,405 A * 8/1995 Storey ..... A45C 9/00 441/126
5,584,422 A * 12/1996 Bond-Madsen ..... A45F 4/02 297/129 X
5,785,427 A * 7/1998 Godshaw ..... A45F 4/02 297/118 X
5,829,835 A * 11/1998 Rogers ..... B62B 3/144 297/129 X
6,145,932 A * 11/2000 Hamel-Nyhus ..... A47D 15/006 297/219.12
6,219,866 B1 * 4/2001 Pascal ..... A47D 5/006 108/93
6,224,152 B1 * 5/2001 Hughes ..... A47D 15/006 297/219.12
6,244,481 B1 * 6/2001 Brougher ..... A45F 4/02 297/118 X
6,402,251 B1 * 6/2002 Stoll ..... B60N 2/265 297/485 X
6,616,242 B1 * 9/2003 Stoll ..... B60N 2/265 297/485 X
6,932,429 B2 * 8/2005 Kamiki ..... B60N 2/2812 297/219.12
7,699,402 B2 * 4/2010 DeLellis ..... B60R 22/02 297/485 X
8,794,709 B2 * 8/2014 Kennedy ..... B60R 22/10 297/485 X
2003/0227202 A1 * 12/2003 Endicott ..... A47D 15/006 297/219.12 X
2003/0230612 A1 * 12/2003 Santos ..... A45C 9/00 224/585
2005/0173292 A1 * 8/2005 Klose ..... A47D 5/006 206/581
2005/0278856 A1 * 12/2005 Welch ..... A47D 15/003 5/655
2007/0029356 A1 * 2/2007 Moriguchi ..... A47D 13/025 224/160
2007/0052278 A1 * 3/2007 Jones ..... A47D 1/103 297/485
2007/0062994 A1 * 3/2007 Shoemaker ..... A41D 13/0012 224/576
2007/0277321 A1 * 12/2007 Leach ..... A47D 5/006 5/655
2008/0272160 A1 * 11/2008 Vou Vakis ..... A45C 9/00 224/155
2009/0114690 A1 * 5/2009 Landay ..... A45C 7/0054 224/575
2009/0158527 A1 * 6/2009 Skophammer ..... A45C 9/00 5/655
2011/0309121 A1 * 12/2011 Dooley ..... A45C 7/0086 224/576
2012/0084917 A1 * 4/2012 Wiggins ..... A47D 13/02 5/482

FOREIGN PATENT DOCUMENTS

WO 02098263 A1 12/2002
WO 2009/009842 A1 1/2009

OTHER PUBLICATIONS

FI Search Report, dated Feb. 12, 2013, from corresponding FI application.
Supplementary European Search Report, dated Mar. 8, 2016, from corresponding European application.
Chinese Office Action, dated Apr. 26, 2016, from corresponding Chinese application.

* cited by examiner

ARRANGEMENT CONVERTIBLE INTO BABY CARE ITEMS

TECHNICAL FIELD

Generally, the invention relates to an arrangement convertible into baby care items. More specifically, the invention relates to an arrangement convertible into baby care items being convertible at least into a bag, a changing mat, chair padding and an infant carrier.

BACKGROUND TECHNOLOGY

Everybody having a small baby knows the large number of items needed to be carried with, when travelling or even visiting outside home. Food and/or milk formula or a water bottle at least, diapers, diaper change accessories, such as wipes, ointment or lotion, soothers, some toys and clean clothes to change are the basic accessories needed to take along for taking care of the baby.

Typically, when traveling with a baby, a baby carriage or strollers are taken along, or the baby is carried with a portable car seat. Unfortunately, a baby carriage or strollers comprise only a little of room for all kinds of accessories and the portable car seats almost none. However, many items may be needed, when being away from home, such as a safe, comfortable and clean place for laying the baby down, when it is time to change diapers, and a bag for carrying all kinds of needed accessories.

Furthermore, when the baby needs to be fed, a highchair or a correspondence is useful for the baby, age of six months or more. Feeding solid food with a spoon is hard to perform while having the baby on the lap, but it is dangerous to seat the baby in a regular chair, because the baby can easily fall down and hurt himself/herself. Some restaurants might have highchairs available, but also in that case, they might be too big for a small baby and do not offer required support.

In document EP2077082A is disclosed a booster seat, which is interchangeable/convertible with a bag. In the seat configuration, the shoulder strap of the bag works as an adjustable strap for fastening the seat to a chair. The seat base of the bag comprises a pocket for the accommodation of a removable padding. Preferably, the padding is a foldable changing mat.

Unfortunately, this solution has disadvantages. The changing mat working as padding in the seat configuration is disposed inside a pocket and needs to be taken out, which can be impractical and complicated to perform, when a caretaker is carrying the baby at the same time. Moreover, the changing mat has to be folded back, when not needed, which can be difficult to perform so that the padding sets in a right way inside the pocket. The shoulder strap for fastening the booster seat to a seat, limits the type of chairs to which the booster seat can be fastened. It may not provide a sufficient fastening for all kinds of chairs, because some chairs have arms, for example, over which the shoulder strap cannot be fastened.

In addition, fastening the booster seat only with the shoulder strap may not be sufficient fastening, and it might happen that the booster seat slips away from the chair, especially if the chair does not contain shoulders, dropping the baby off, which can obviously be dangerous for the baby.

SUMMARY OF THE INVENTION

It is an object of the present invention to implement such a solution, that previously mentioned drawbacks of the prior art could be diminished. In particular, the invention is implied to solve how to provide an arrangement comprising most of the items and accessories in one compact entity needed for taking care of a baby outside home.

The objective of the invention is met by the features disclosed in the independent patent claim.

An arrangement convertible into baby care items according to the present invention is characterized by the features of claim 1.

According to an embodiment of the invention, an arrangement convertible into baby care items comprises a two sided foldable material having a first side and a second side, which material comprises fixing points for carrying means, carrying means connected to the material for carrying and fastening the arrangement, a first fixing means attached to the first side of the material, and a second fixing means attached to the second side of the material. Further, the arrangement can be converted into a folded form forming a bag, into a semi-folded form forming chair padding, and into an unfolded form forming, when the material is set the first side up, a changing mat for diaper changing, or, when the material is set the second side up, an infant carrier.

In one embodiment, the first fixing means is a three-point belt for fastening the infant carrier to a chair behind the backrest of the chair. This feature may enable fast and safe fastening of the infant carrier to a chair. In addition, the types of chair, to which the infant carrier can be fastened, may vary widely, because the three point belt may provide an easily adjustable fastening for different types of chairs having a backrest, though.

In another embodiment, the first fixing means is a four-point belt. This feature may enable the arrangement arranged into the infant carrier form to be fastened to a chair, or carried by a person. When a person uses the infant carrier for carrying a baby, the carrier can be mounted to the front side or to the back side of the person. In addition, the four-point belt may further comprise one or more connector belts for connecting the straps of the belt together and, thus, improving the fastening of the infant carrier to a chair or a person.

Yet, in another embodiment, the arrangement according to the present invention further comprises an openable compartment for the first fixing means. This feature enables the first fixing means to be hidden, when not needed and when the material is used as a changing mat. This feature is advantageous, because, in this way, the first side of the material can be cleared from extra components and safe and comfort mat can be provided for the infant to be cared. Normally, fixing means are not needed, when changing the infant's diaper, because the bottom of the infant is usually washed and that procedure requires lifting and carrying the infant, which is, obviously, difficult to perform, if the infant is restrained by the fixing means.

In one embodiment, the second fixing means is a five-point belt for fastening an infant to the infant carrier or to the chair padding. The five-point belt may ensure secure and easy fastening of a baby to the infant carrier or the chair padding. When a clear area can be provided for the changing mat in the first side of the material, the second fixing means can always remain exposed on the second side, which may enable more reliable second fixing means to be provided in the second side of the material for fixing the baby to the infant carrier.

Yet, in another embodiment, the carrying means is an adjustable strap, which is arrangeable for fastening the infant carrier or the chair padding to the chair below the seat section of the chair or behind of the backrest of the chair. The fastening is easy to perform, because one end of the adjustable strap can be easily released from the fixing points of the material and guide below the seat section or behind the backrest, reconnect to its fixing points and adjust to a suitable length. The adjustable strap may provide a versatile carrying means for enabling the arrangement as a form of the bag to be carried on a shoulder, or to be connected to a baby carriage or strollers or a bicycle, for example.

In one embodiment, the part of the five-point belt is detachable from the material and connectable with the carrying means, e.g. a shoulder strap, or with an additional strap in order to form a safety harness for an infant.

In one embodiment, the arrangement further comprises a covering part fixedly arranged to the first side of the material for an additional or alternative fastening the infant carrier to a chair and for covering the backrest of the chair.

Yet, in another embodiment, the arrangement further comprises an openable compartment provided in the material for a blanket. The blanket arranged into the openable compartment can be useful in many ways: the blanket can be used for covering the changing mat providing an extra padding and preventing the changing mat to becoming dirty. Moreover, the blanket can be set under the chair padding or infant carrier for the same reasons; preventing the chair to becoming dirty and providing an extra padding.

In one embodiment, the arrangement according to present invention further comprises a number of separate compartments for accessories, which compartments are interconnectable and disposable into the bag.

Some preferable embodiments of the invention are described in the dependent claims.

Significant advantages can be achieved with the present invention when compared to the prior art solutions. The arrangement according to the present invention is made of a durable and washable material and it is simple to manufacture. It is lightweight and easy to carry with. It is compact and it may be effortlessly converted into a several items needed to take care of a baby, when travelling outside home. The arrangement can be converted into a bag, chair padding, and an infant carrier mounted to a chair or carried by a person. Further, the fixing means of the arrangement can be converted into a safety harness, when detaching from the material and connecting to a strap, for example.

The material of the arrangement can be effortlessly folded into the bag form or unfolded into the chair padding, the changing mat or the infant carrier. In the bag form, the arrangement can contain separate and interconnectable compartments for accessories, such as food and/or milk formula, a bottle for milk and/or water, diapers, wipes, ointment and/or lotion, soothers, some toys and clean clothes to change. In the changing mat form, the separate interconnectable compartments can be conveniently on hand, so that, for example, the diaper changing can be easily performed and there is no need to leave the baby alone to the changing mat. The material can further comprise extra pocket for accessories, such as diapers, so that the arrangement may comprise sufficient amount of storage space for all needed accessories in a compact form.

In addition to the changing mat, the cleared area of the material's first side can be used as a play mat, which may provide for the infant safe and comfort base for lie and observe the environment.

In the chair padding form, the arrangement can be used in several cases. The chair padding can be arranged in a highchair for adjusting the space of the highchair to be more suitable for a small baby and also for padding the seat of the highchair. In a padding purpose, the chair padding can also be used in a car booster seat or in the seat of a shopping cart. The chair padding can be quickly fastened with the shoulder strap of the arrangement, which may make it user friendly.

Furthermore, in the infant carrier form, it may be also very fast and easy to fasten a baby in a seating position to a chair. Different types of chair may be used, because the arrangement comprises various fixing means, such as tree-point belt or four-point belt for fastening the infant carrier to the backrest of the chair, a shoulder strap for additional or alternative fastening the infant carrier to the backrest of the chair or below the seat of the chair. The hood provided into the material may further be used as an additional fixing means, but, in addition, it may cover the backrest of the chair for preventing it to become dirty.

The arrangement comprises an openable compartment for a blanket, which blanket can be used for covering the seat section of the chair or the changing mat. In this way, it is easy to cover a chair from e.g. food stains and preserve the fabric of the furniture, while using it as a highchair. Moreover, it is easy to use the covering part, which is fixedly arranged to the material, to cover the backrest of the chair.

SHORT DESCRIPTION OF THE DRAWINGS

Figure 2A:
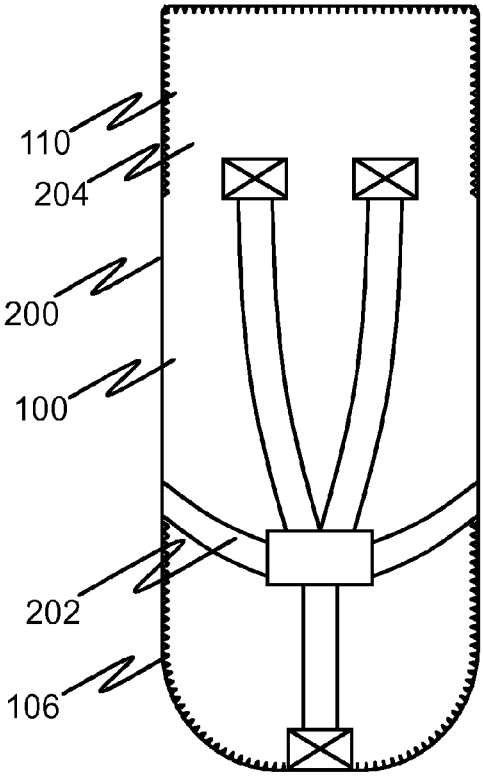
Figure 2B:
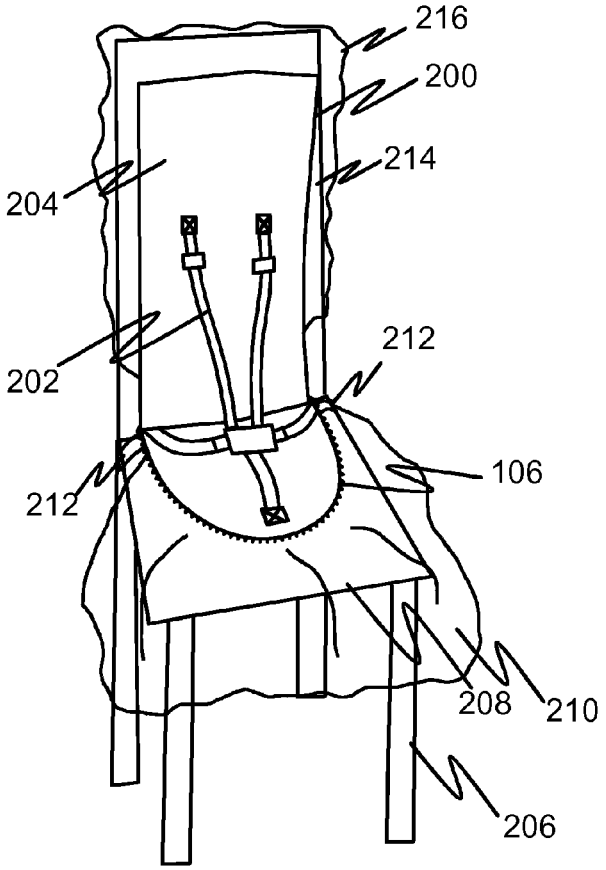
Figure 2C:
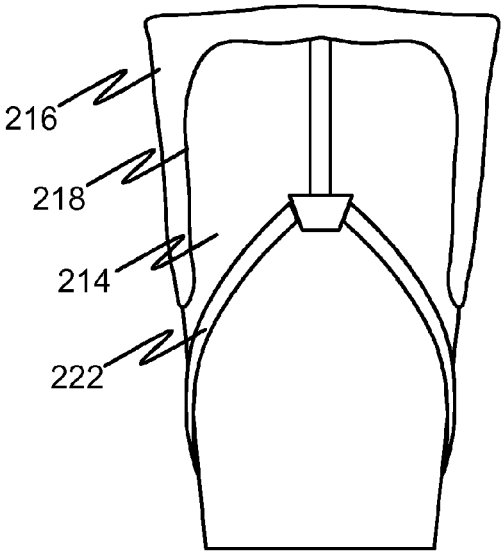
Figure 3A:
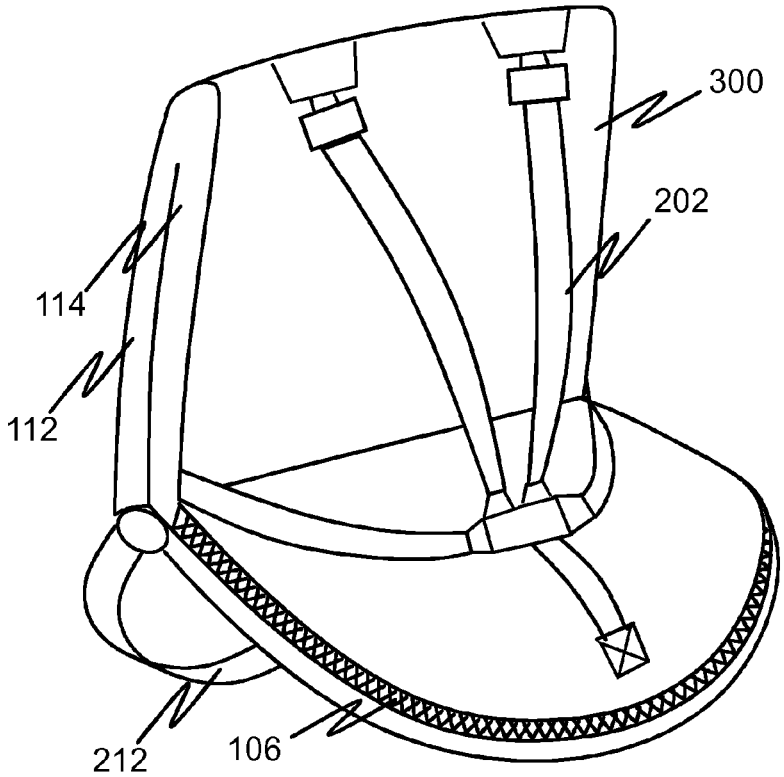
Figure 4:
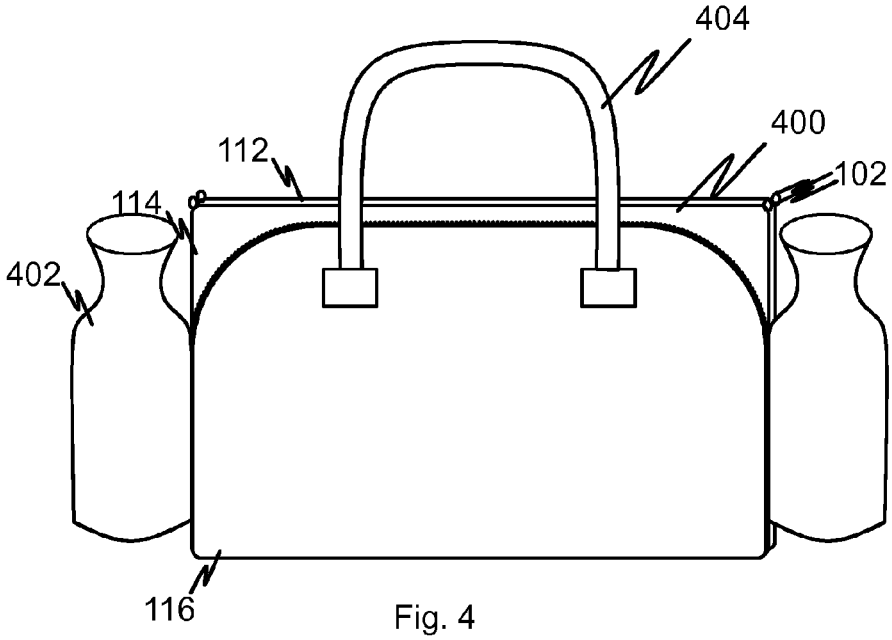
Figure 3B:
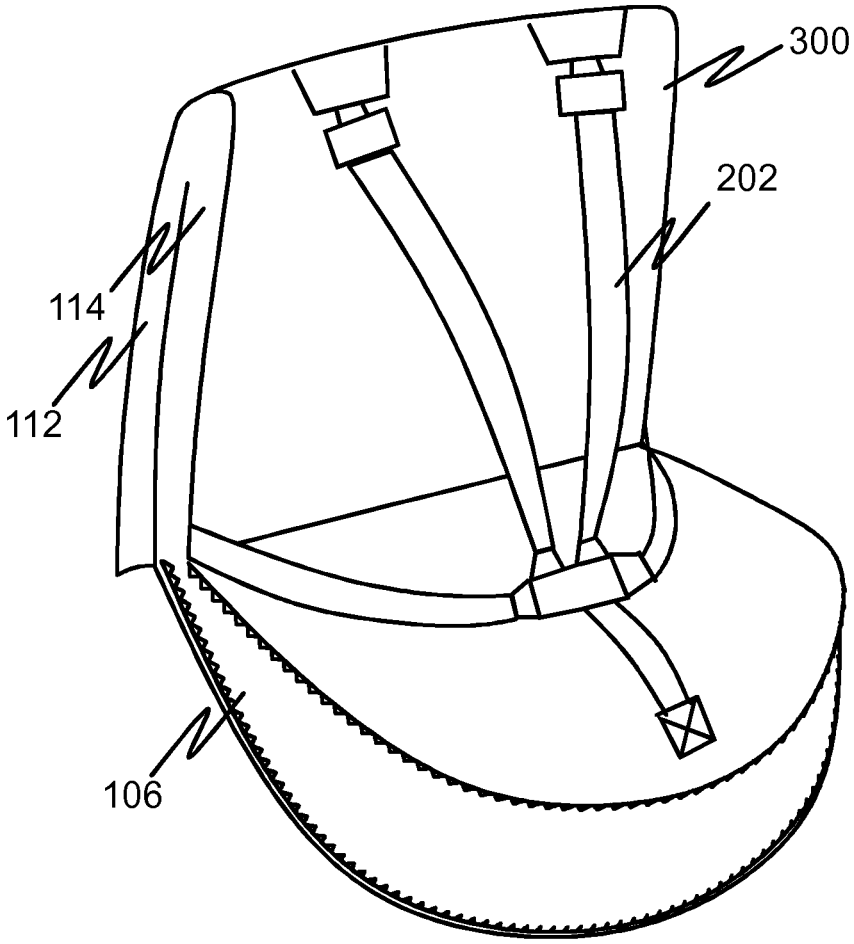

Next, the invention is described in more detail with reference to the appended drawings, in which FIG. 1 illustrates an arrangement according to an embodiment of the present invention in an unfolded form forming a changing mat, FIG. 2*a* illustrates an arrangement according to an embodiment of the present invention in an unfolded form forming an infant carrier, FIG. 2*b* illustrates the arrangement in FIG. 2*a*, wherein the infant carrier is fastened to a chair, FIG. 2*c* illustrates an embodiment of the arrangement in FIG. 2*b* depicting the fastening of the infant carrier to the chair behind the chair, FIG. 3*a* illustrates an arrangement according to an embodiment of the present invention in a semi-folded form forming a chair padding, FIG. 3*b* illustrates the arrangement in FIG. 3*a* and an openable compartment for a blanket in an open form according to an embodiment of the present invention, FIG. 4 illustrates an arrangement according to an embodiment of the present invention in a folded form forming a bag.

DETAILED DESCRIPTION OF THE EMBODIMENTS

The arrangement convertible into baby care items according to the present invention comprises a two sided foldable material having a first side and a second side, carrying means for carrying and fastening the arrangement, first fixing means attached to the first side of the material and second fixing means attached to the second side of the material.

In one embodiment, the arrangement according to the present invention can be converted into a bag, a chair padding, an infant carrier or a changing mat. In another embodiment, the arrangement can be further converted into a safety harness for an infant.

FIG. 1 illustrates an arrangement according to an embodiment of the present invention in an unfolded form forming a changing mat. The material 100 has two sides and when the material is in its unfolded form having the first side 220 up, it forms the changing mat.

The material 100 can be divided into three parts; an upper part 112, a middle part 114 and a lower part 116. The intersections (depicted as dotted lines) between the upper part 112 and the middle part 114 as well as between the middle part 114 and the lower part 116 provide folding sections from which the material can be folded. The material can comprise e.g. seams made of stiches to alleviate the folding process.

The material 100 of the present invention is preferably made of some durable and washable material, such as, but not limited to, cotton, polyester and/or suitable plastics. It is obvious for the person skilled in the art, that different part of the material according to the present invention can be made of different fabrics and/or materials and the material according to the present invention in its entirety can be a combination of various suitable fabrics and/or materials.

The size of the material can vary, but preferably the width of the material is e.g. 25 cm-50 cm, more preferably e.g. 28 cm-45 cm, and the most preferably e.g. 31 cm-40 cm. Respectively, the length of the material is preferably e.g. 50 cm-100 cm, more preferably e.g. 60 cm-90 cm, and the most preferably 75 cm-80 cm.

The shape of the material is preferably a rectangle, but e.g. corners of the material can be slightly rounded, especially bottom corners. This feature alleviates folding the material into a bag form and setting the material into a highchair as chair padding. Especially, the width of the material is selected so that it sets firmly to the seat of a highchair having the width usually about 30 cm.

Moreover, the material 100 of the present invention further comprises a first compartment 106 for an extra blanket, which compartment 106 is preferably provided in the bottom side 104 of the material 100. Preferably, the first compartment 106 is arranged between the first side and the second side of the material 100 and in FIG. 1 is depicted a zip fastener of the compartment 106, which is, naturally, for illustrating purposes only for illustrating a possible place for the first compartment 106 in the material 100. The first compartment 106 is openable, which can be implemented in several different ways. In a preferable embodiment, the compartment comprises a zip fastener for opening and closing the compartment, but the person skilled in the art will understand that the compartment 106 can also comprise e.g. Velcro strips, buttons, snap fasteners or some other fastening means for closing and opening the compartment. The size of the first compartment 106 may vary, but preferably the first compartment is the size of the lower part 116.

In one embodiment, the arrangement further comprises an extra blanket disposed in the first compartment 106 of the material 100. The extra blanket can further be used for covering the changing mat, which provides an extra padding on the mat and may prevent the changing mat to become dirty, when changing baby's diaper on the mat, for example. Naturally, the size and the material of the extra blanket can vary, but preferably the size of the blanket can be e.g. 60 cm×80 cm, which provides an area sufficiently large for covering the changing mat and/or the seat section of a chair, for example, in cases, wherein the arrangement is converted into the infant carrier. The extra blanket can be made of some warming, comfortable and washable material, such as, but not limited to, wool, cotton or fleece and, in one embodiment, the other side of the blanket is made of some other material suitable for preventing the blanket from slipping when set onto the changing mat or to a chair.

In one embodiment, the material 100 further comprises a second compartment 110 for the first fixing means. Preferably, the second compartment 110 is provided in the upper side 108 of the material 100 and it is arranged between the first side and the second side of the material 100. In FIG. 1 is depicted a zip fastener of the compartment 110, which is, naturally, for illustrating purposes only for illustrating the possible place of the compartment 110 in the material 100. The compartment 110 is openable, i.e. the compartment comprises e.g. a zip fastener or some other closing means as described above in connection with the first compartment 106. The openable second compartment 110 for the first fixing means is advantageous, because in that way the first fixing means can be hidden, when the first side of material is in use as the changing mat and a soft base is provided for the baby without any extra component exposed.

The material 100 further comprises fixing points 102 for carrying means. In one embodiment, the material 100 comprises at least two fixing points in a side for enabling the material to be folded to and restrained in a bag form. The fixing points 102 can be e.g. rings or links made of metal or some suitable plastic, which provides hard and durable fixing points for carrying means. In FIG. 1, the size of the fixing points is highly exaggerated for illustrating purpose. Respectively, both ends of the carrying means (not shown in FIG. 1) comprise means to be connected to the fixing points, such as clasps, for example. Folding and fastening the material to a bag form is described more precisely below.

In FIGS. 2*a*, 2*b* and 2*c* are illustrated an arrangement according to an embodiment of the present invention in an unfolded form forming an infant carrier 200, the infant carrier 200 fastened to a chair 206, and fastening of the infant carrier in the chair 206 behind the chair. The arrangement according to the present invention is converted into the infant carrier form, when the arrangement is in its unfolded form and the material is set the second side 204 up.

The person skilled in the art will understand that when the material is set the second side up, it does not need to be laid onto any plane, but the expression "the second side up" is meant in a wider form expressing that a baby can be set to the second side of the material. In the infant carrier form, the material can be set to a chair or carried by a person, so that the first side is towards the chair or the person.

The second fixing means are attached to the second side 204 of the material for fastening a baby to the infant carrier 200. In one embodiment, the second fixing means is an adjustable five-point belt 202. It is obvious for the person skilled in the art that any suitable five-point belt can be used as second fixing means. In some embodiments, wherein the infant carrier is meant to be carried, the lowest strap can be widened or some other way formed so as distributing the baby's weight in a wider area, which may increase the baby's comfort in the infant carrier. In a preferred embodiment, the second fixing means are always exposed on the second side of the material, which enables reliable and comfort second fixing means to be provided in the second side of the material for fixing the baby to the infant carrier.

In an embodiment, the second fixing means are attached to the material so that they cover the middle part 114 and the lower part, but leave the upper part 112 clear. In this way the arrangement of the present invention can easily be arranged into the semifolded form by folding the upper part backwards and so that the second fixing means are still available for fixing the baby to the chair padding.

In one embodiment, at least part of the five-point belt 202 can be detached from the second side of the material 204 and further connect with the carrying means of the present invention or with an additional strap in order to form a safety harness for an infant. Preferably, the upper straps and the side straps are detachable and interconnectable with each other or connectible with the strap/carrying means. In this embodiment, the five-point belt 202 can be attached to fixing points provided in the side of the material. In some embodiments, some or all of the fixing points can be the same used for connecting the carrying means.

As can be seen in FIG. 2*b*, the extra blanket 210 can be set to cover the chair 206 to which the infant carrier 200 is fastened. For illustrating purposes the extra blanket is depicted as transparent material. The extra blanket 210 can be set to the chair so that it is partly disposed inside its compartment 106 and extending from there to cover the rest of the chair's seat section. In that way, the extra blanket 210 and the infant carrier 200 or the chair padding stays may stay better in their places on the chair 206, because the baby is set to sit upon the container 106 and the extra blanket 210 in it. In embodiment, wherein one of the blanket's sides comprises an anti-skid material, the anti-skid side is set downwards against the surface of the chair, naturally.

Depending on embodiment, several fixing means can be used for fastening the infant carrier 200 to a chair. In embodiment, wherein the carrying means of the invention is an adjustable strap 212, e.g. a shoulder strap, the strap 212 comprises connecting means, as described above, to connect and disconnect the strap to/from its fixing points in the material. The strap is further guided below the seat section 208 of the chair 206 or behind the backrest 214 of the chair 206. Then, the adjustable strap 212 is adjusted to be sufficiently tight and reconnect to its fixing point in the material.

In an embodiment, the adjustable strap comprises an extra link provided in the strap. The place of the extra link in the strap can be e.g. about 5-10 cm from its one end and the connecting means, such as a clasp, provided in the end of the strap, can be connected to the extra link after being disconnected from its fixing point and guided behind the chair and through the fixing point in the material. The extra link can then be used for adjusting the length of the adjustable strap by pulling it to desired direction in order to tighten or loosen the strap. Thus, the purpose of the extra link is to provide a good grip for a user to adjust the length of the strap.

In embodiment comprising the extra link, the end of the strap near the extra link can be implemented with a differing way, e.g. with a different color and/or form, to indicate the end, which is advantageously disconnected, when the strap is used for fastening purposes. The connecting means in that end can be a different kind of clasp, bigger and/or easier to be opened, for instance, and/or provided with highlighted color, for example, or indicated with some other means.

In FIG. 2*b* can be seen the covering part 216 according to an embodiment of the present invention. For illustrating purposes, the covering part is depicted as transparent material. Preferably, the covering part 216 is fixedly arranged to the material according to the present invention. In one embodiment, the material can comprise a compartment for the covering part, which compartment can be openable and closable by means of a zip fastener, for example. The person skilled in the art will appreciate that the compartment can be made openable by some other means, e.g. by Velcro strips, buttons, snap fasteners or by some other fastening means. In another embodiment, the second compartment 110 for the first fixing means can further comprise the covering part.

The covering part 216 can be used for an additional or alternative fastening of the infant carrier 200 to a chair and for covering the backrest of the chair. Preferably, the covering part 216 has a shape of a hood and its outer end comprises some elastic material 218, such as an elastic band (FIG. 2*c*). The covering part 216 can be set to cover the upper backrest 214 and the sides of the chair. A part of the covering part is arranged to exceed to the backside of the chair. In this way, the covering part 216 provides an additional or alternative fastening of the infant carrier 200.

The material of the covering part is selected so that the covering part provides a durable and robust cover for a chair, which material is also easy to clean. When arranged to the compartment in the material, the covering part may form a border to the upper side part and the upper side of the material, which can advantageously provide protection for the baby on the changing mat. The size of the covering part is selected so that the infant carrier can be arranged to wide range of different chair types having a backrest, in spite of the height, width or thickness of the backrest. The person skilled in the art will understand that the size of the covering part can be individually select to cover a chair having a really deviant backrest.

In FIG. 2*c* is depicted the infant carrier 200 fastened to the chair 206 so that the first fixing means are exposed. According to an embodiment, the first fixing means is an adjustable three-point belt 222 for fastening the infant carrier to a chair behind the backrest 214 of the chair. It is obvious that the three-point belt 222 can be any suitable three-point belt type available. Preferably, the ends of the straps of the three-point belt 222 are attached to the seam of the material, but the attachment of the three-point belt can also be arranged in some other way. The lower straps of the three-point belt 222 are preferably connected to a sufficient low level in the material, preferably near to the level, where the side straps of the five-point belt are connected The three-point belt 222 is adjustable for providing a fast and safe fastening of the infant carrier to several different types chairs. As typically, the three point belt can be opened and closed so that at least one, preferably all three straps are disconnectable from each other. In that way, the infant carrier can be set to a chair, adjust the straps to a suitable length and reconnect the straps with each other.

In another embodiment, the first fixing means is an adjustable four-point belt enabling the infant carrier to be fastened to a chair or carried by a person. The upper end of the straps of the four-point belt is arranged to be attached to the material in the upper part of the material, in the seam of the material, for example, and the lower end of the straps from a lower level of the material, as described above. In one embodiment, the four-point belt comprises e.g. four straps, which are interconnectable with at least one other strap, or all four straps can be connected with each other. At least two of the straps are adjustable providing means for adjust the length of the straps. In the present embodiment, the straps can be connected crosswise or straight depending on fastening needs and the chair, to which the infant carrier is intended to be fastened. In other embodiment, the four-point belt comprises two adjustable straps, which can be connected crosswise or straight. In this case, the infant carrier can be set to the chair from above the backrest of the chair. In another embodiment, having a four-point belt as a form of straight straps, the straps comprise means for connecting the straps with each other, such as an extra strap provided in one strap, which can be connected to the other straps. This feature can provide extra safety for fastening the infant carrier, when fastening it to a chair or carrying it.

In one embodiment, the lower straps of the first fixing means are connected to the fixing points arranged in the side of the material. The same fixing points or adequate part of them can also be used for connecting the carrying means of the arrangement to the material, as well as the second fixing means.

As described above, the material can comprise the second compartment for the first fixing means and the second compartment is openable so that the first fixing means can be taken out when desired to fasten the infant carrier to a chair. Part of the opened container can be folded downwards against the lower backrest of the infant carrier in the fastening position of the infant carrier for exposing the first fastening means for use.

The person skilled in the art will understand that any combination of above described fixing means can be used for fastening the infant carrier to a chair, and the suitable fixing means are selected depending on the type of the chair the infant carrier are going to be fastened to.

In the embodiment, wherein the first fixing means is an adjustable four-point belt, the infant carrier can also used for carrying the baby by an person either front side or backside the person. The baby is fastened to the infant carrier with the second fastening means and the infant carrier is lifted to the back or to the front side of the person and carried by means of the four-point belt.

In an embodiment, the arrangement according to the present invention further comprises an extra braces for a person to wear, which braces comprise means to be connected to the material, e.g. to the fixing points or to the second fixing means in order to carry the baby. The braces can be set several manners onto the person, e.g. over the shoulders and behind the back of the person. The material can be e.g. in the infant carrier form or in the chair padding form. In another embodiment, the second fixing means are disconnectable and connectible to the extra braces so as to form a lighter infant carrier.

FIG. 3*a* illustrates an arrangement according to an embodiment of the present invention in a semi-folded form forming a chair padding 300, and FIG. 3*b* illustrates the arrangement in FIG. 3*a* and an openable compartment 106 for a blanket according to an embodiment of the present invention. The compartment 106 for the extra blanket is already described above. The person skilled in the art will understand that the material can also comprise more compartments, such as extra pockets, for accessories, which can be provided between the sides of the material and/or on the side(s) of the material. The size of the extra compartments can vary depending on embodiment.

In one embodiment, the arrangement according to the present invention is converted into the chair padding by folding the upper part 112 of the material backward towards the first side of the material so that the upper part 112 and the middle part 114 of the material is set one upon the other. In this way, the chair padding 300 is set to a chair, for example to a highchair and the second fixing means, five-point belt 202 in the present invention, are available to fasten the baby to the chair padding 300. In another embodiment, the chair padding is converted by folding the upper part 112 of the material forward towards the second side of the material and the material is set to the chair the first side up. In this embodiment, the second fastening means are not available. The person skilled in the art will understand that the material can also be folded with some other ways to form a suitable chair padding.

In one embodiment, the chair padding is fastened to the chair by means of the carrying means. In embodiment, wherein the carrying means is a shoulder strap 212, the strap can be connected to the chair in a way described in the connection of the infant chair above.

In another embodiment, the second fixing means can be used for fastening the chair padding or the infant carrier to the chair. In the present embodiment, the side straps of the second fixing means are disconnectable so that the side straps can be disconnected and guided between e.g. side bars of the chair and/or bars of the backrest of the chair and then reconnected to their respective parts in the material. This feature may further improve the fastening of the infant carrier or the chair padding to a chair or provide an alternative fixing means.

It should be obvious to those skilled in the art that the first fixing means, such as three-point belt and four-point belt, and the second fixing means, such as five point belt, according to the present invention can comprise any kind of adjusting means for adjusting the length of the straps of the belt in question.

FIG. 4 illustrates an arrangement according to an embodiment of the present invention in a folded form forming a bag 400. Furthermore, the arrangement according to the present invention is converted into the bag 400 by folding all three parts 112, 114 and 116 of the material. In one embodiment, the lower part 116 is folded upon the middle part 114 toward the second side of the material so that the second fixing means are hidden between the lower part 116 and the middle part 114. Then, the upper part 112 is folded upon the middle part 114.

In embodiment, wherein the arrangement comprises one or more separate compartments for accessories, the separate compartment(s) 402 is/are disposed between the upper part 112 and the middle part 114, before the upper part 112 is folded upon the middle part 114. In one embodiment, the separate compartments are interconnectable. In another embodiment, the separate compartments are fixedly attached to each other, but in both embodiments some compartments or part of the compartments can remain outside the bag.

The carrying means are connected to the fixing points 102 so as to form the bag 400 and restraining the material in the bag form. In an embodiment, the both sides of the material comprise two fixing points 102. Preferably, the fixing points of the present embodiment are arranged in the folding section between the middle part 114 and the lower part 116 and the upmost corner of the upper part.

In one embodiment, the material further comprises extra means for restraining the material in the bag form, such as Velcro strips, press studs, hooks and eyes, buttons and buttonholes, toggles and/or extra strip provided in appropriate parts of the material to keep the material in the folded form. The extra means for restraining the material in the bag form can be sufficient in embodiments, where there are no separate compartments to dispose between the parts of the material. In that case, the carrying means can be connected to only one fixing point in each side or the bag is carried from handles 404 or in some other way.

In one embodiment, the carrying means is the adjustable strap as described above, but the carrying means can be arranged in some other way, too. For example, carrying means can be implemented in a form of straps for a backpack, which straps can be disconnected from the material and interconnected with each other in order to fasten the infant carrier or the chair padding to a chair In addition, the carrying means can further comprises one or more fixed handles 404, for example, which handles are attached to the material so that in the bag form, the bag can be carried by means of the handles.

In an embodiment, the arrangement according to the present invention further comprises a matrix barcode, such as Quick Response Code, which can be used for transferring information about the arrangement, such as a user guide and/or guiding videos, for a user to his/her smartphone, for example. The matrix barcode is advantageously attached to a visible spot, such as in a corner of the material, so that the matrix code is clearly visible, when the material is in the bag form. The person skilled in the art will understand that the matrix code can be placed in some other place or component of the arrangement, such as in the carrying means.

The scope of the invention is determined by the attached claims together with the equivalents thereof. The skilled persons will again appreciate the fact that the explicitly disclosed embodiments were constructed for illustrative purposes only, and the scope will cover further embodiments, embodiment combinations and equivalents that better suit each particular use case of the invention.

The invention claimed is:

1. An arrangement convertible into baby care items comprising:

a two sided foldable material having a first side and second side, which material comprises fixing points for carrying means, carrying means connected to the fixing points of the material for carrying and fastening the arrangement, first fixing means attached to the first side of the material, and second fixing means attached to the second side of the material, wherein the arrangement is arrangeable into a folded form forming a bag, into a semi-folded form forming a chair padding, and into an unfolded form forming, when the material is set the second side up, an infant carrier and, when the material is set the first side up, a changing mat for diaper changing, and wherein the arrangement further comprises an openable compartment for the first fixing means to be hidden, when said first side is used as the changing mat.

2. An arrangement convertible into baby care items according to claim 1, wherein the first fixing means is an adjustable three-point belt for fastening the infant carrier to a chair behind the backrest of the chair.

3. An arrangement convertible into baby care items according to claim 1, wherein the first fixing means is an adjustable four-point belt enabling the infant carrier to be fastened to a chair or carried by a person.

4. An arrangement convertible into baby care items according to claim 1, wherein the second fixing means is an adjustable five-point belt for fastening an infant to the infant carrier or to the chair padding.

5. An arrangement convertible into baby care items according to claim 1, wherein both sides of the material comprise two fixing points, which fixing points are connected to the carrying means for restraining the material in a bag form.

6. An arrangement convertible into baby care items according to claim 1 further comprising a covering part fixedly arranged to the material for an additional or alternative fastening of the infant carrier to a chair and for covering the backrest of the chair.

7. An arrangement convertible into baby care items according to claim 1 further comprising an openable compartment provided in the material for an extra blanket.

8. An arrangement convertible into baby care items according to claim 1 further comprising a number of separate compartments for accessories, which compartments are interconnectable and disposable into the bag.

9. An arrangement convertible into baby care items according to claim 1, wherein at least part of the second fixing means are detachable from the material and further connectible with the carrying means or with an additional strap in order to form a safety harness for an infant.

10. An arrangement convertible into baby care items, comprising:

a two sided foldable material having a first side and a second side, the first side being a top side, the second side being a bottom side, the material being divided into three parts comprised of an upper part, a middle part, and a lower part, intersections between the upper part and the middle part and between the middle part and the lower part having folding divisions that alleviate a folding process, wherein when the material is in an unfolded form having the first side up, the arrangement forms a changing mat;

a first fixing element attachable to the first side of the material, for fastening the material to a chair behind a backrest of the chair, to arrange the material as an infant carrier fastened to the chair;

a second fixing element attached to the second side of the material, the second fixing element being a belt system for fastening an infant to the material, wherein when the second fixing element is attached to the second side of the material, the arrangement forms the infant carrier;

fixing points located on the material;

a carrying element attachable to and detachable from the fixing points, wherein with the carrying element attached to the fixing points, the arrangement folds into a folded form forming a bag;

a blanket compartment provided on the bottom side of the material and arranged between the first side and the second side of the material, an opening of the blanket compartment extending along a perimeter of a first end of the material; and a fixing element compartment for storage of the first fixing element, the fixing element compartment provided on the top side of the material and arranged between the first side and the second side of the material, an opening of the fixing element compartment extending along a perimeter of a second end of the material, the second end of the material being opposite the first end of the material, wherein the arrangement is arrangeable into the folded form forming the bag, into a semi-folded form forming a chair padding, and into an unfolded form forming, when the material is set the second side up, the infant carrier and, when the material is set the first side up, a changing mat for diaper changing with the first fixing element being hidden in the fixing element compartment.

11. An arrangement convertible into baby care items according to claim 10, wherein the first fixing element is an adjustable three-point belt for fastening the infant carrier to the chair behind the backrest of the chair.

12. An arrangement convertible into baby care items according to claim 10, wherein the first fixing element is an adjustable belt system enabling the infant carrier to be fastened to the chair and to be carried by a person.

13. An arrangement convertible into baby care items according to claim 12, wherein the second fixing element is an adjustable belts for fastening the infant to the infant carrier or to the chair padding.

14. An arrangement convertible into baby care items according to claim 10, wherein both sides of the material comprise two fixing points, which fixing points are connected to the carrying element for restraining the material in the bag form.

15. An arrangement convertible into baby care items according to claim 10, wherein the second fixing element is an adjustable belts for fastening the infant to the infant carrier or to the chair padding.

16. An arrangement convertible into baby care items, comprising:

a two sided foldable material having a first side and a second side, the first side being a top side, the second side being a bottom side, the material being divided into three parts comprised of an upper part, a middle part, and a lower part, intersections between the upper part and the middle part and between the middle part and the lower part having folding divisions that alleviate a folding process, wherein when the material is in an unfolded form having the first side up, the arrangement forms a changing mat;

a first fixing element attachable to the first side of the material, for fastening the material to a chair behind a backrest of the chair, to arrange the material as an infant carrier fastened to the chair;

a second fixing element attached to the second side of the material, the second fixing element being a belt system for fastening an infant to the material, wherein when the second fixing element is attached to the second side of the material, the arrangement forms the infant carrier;

fixing points located on the material; and a carrying element attachable to and detachable from the fixing points, wherein with the carrying element attached to the fixing points, the arrangement folds into a folded form forming a bag, wherein the arrangement is arrangeable into the folded form forming the bag, into a semi-folded form forming a chair padding, and into an unfolded form forming, when the material is set the second side up, the infant carrier and, when the material is set the first side up, a changing mat for diaper changing.

17. An arrangement according to claim 16, further comprising:

a blanket compartment provided on the bottom side of the material and arranged between the first side and the second side of the material, an opening of the blanket compartment extending along a perimeter of a first end of the material; and a fixing element compartment for storage of the first fixing element, the fixing element compartment provided on the top side of the material and arranged between the first side and the second side of the material, an opening of the fixing element compartment extending along a perimeter of a second end of the material, the second end of the material being opposite the first end of the material.

* * * * *